US006446549B1

(12) United States Patent
Soucie et al.

(10) Patent No.: US 6,446,549 B1
(45) Date of Patent: Sep. 10, 2002

(54) HAND-HELD PAPER EMBOSSING TOOL

(76) Inventors: Carla B. Soucie, P.O. Box 455, Bradely, ME (US) 04411; Peter W. Soucie, P.O. Box 455, Bradely, ME (US) 04411

( * ) Notice: Subject to any disclaimer, the term of this patent is extended or adjusted under 35 U.S.C. 154(b) by 0 days.

(21) Appl. No.: 09/715,488

(22) Filed: Nov. 16, 2000

(51) Int. Cl.[7] ..... B31F 1/07

(52) U.S. Cl. ..... 101/4; 101/3.1; 101/5; 400/134.4

(58) Field of Search ..... 101/3.1, 4, 5, 16, 101/28, 35, 41; 401/209, 214; 400/127, 134.4

(56) References Cited

U.S. PATENT DOCUMENTS

| | | | | | |
|---|---|---|---|---|---|
| 2,107,424 | A | * | 2/1938 | Platt | 120/43 |
| 5,888,009 | A | * | 3/1999 | Toyama | 401/188 A |
| 5,906,447 | A | * | 5/1999 | Horikoshi | 401/214 |
| 6,042,290 | A | * | 3/2000 | Ishikawa et al. | 401/214 |

* cited by examiner

*Primary Examiner*—Andrew H. Hirshfeld
*Assistant Examiner*—Kevin D. Williams
(74) *Attorney, Agent, or Firm*—Pedersen and Company, PLLC; Ken J. Pedersen; Barbara S. Pedersen

(57) ABSTRACT

The present invention is a hand-held tool for embossing a sheet of paper or other media, and a method for performing the embossing. The tool is preferably a two-ended embossing tool, wherein each end has differently-sized roller ball that rotates/rolls in all directions inside a retainer. Each roller ball is biased outward, for example, by a detent-style spring unit. The preferably spring contacts the ball, so that the ball(s) and the spring(s) is/are the only moving parts of the tool. To use the tool, preferably the user applies pressure to the tool over paper or other media on top of a template with open channels in the shape of a desired design. The ball is received in the channel with the paper or other media lying between the exposed ball surface and the template. A guide surface extends out from the ball to be generally parallel to the surface of the paper beside the channel area. Thus, while the guide surface rests on and slides along paper firmly supported by the template, the ball moves along the paper in the channel, and the force of the ball depresses the paper into the channel of the template, permanently or semi-permanently embossing the paper in the chosen design. The pressure of the ball on the paper is kept substantially even and constant by the spring-biasing system, and the guide surface helps the user to find the areas of the paper over the channel and to stay in the channel without mistakes and without the need for a light-box. Each tip of the tool may also include a ball stop that limits the amount the ball can move into the tool, for preventing the ball from moving so far inward that the retainer inner edge scraps the media. This combination, of even ball pressure, ball diameter nearly as large as the channel width, and guide surface overhanging supported areas of the template, tends to prevent marring, skipping, dragging, tearing, or gouging of the paper.

16 Claims, 6 Drawing Sheets

PRIOR ART 2
3
4
5
6
8
10
11
12
13
14
15

HAND-HELD PAPER EMBOSSING TOOL

BACKGROUND OF THE INVENTION

1. Field of the Invention

This invention relates generally to hand-held tools for use in hobbies and crafts such as scrap-booking. More specifically, the invention relates to an embossing tool for use with templates for embossing paper and other media to create designs, lettering, and other effects desired for a scrapbook, notecard, or other decorative article.

2. Related Art

Several hand-held tools exist for embossing paper or other media. These embossing tools have been used in the past by artists, printers, and hobbyists to create designs, lettering, or borders on a variety of media. Typically they use the tools with a template and a light-box in a technique called "dry embossing." The user places the template having the desired pattern on a light-box, and places the media on the template with both template and media in reverse, that is, with the front of the template and the front of the media face down on the light-box. The user is thus able to see the pattern of the template "channels" as a light area through the media, and he/she traces over the pattern or desired portion of the pattern by pressing the tip of the embossing tool on the media. The tip forces the paper into the template channel(s) to permanently deform the paper to create an embossed pattern, that is, a raised pattern when viewed from the front surface of the paper.

One tool that may be used for embossing is the conventional stationery ball stylus 2 illustrated in FIG. A. This stylus tool 2 consists of a central handle 3, typically of wood, with two opposing stylus ends 4 extending out from the handle. Each stylus end 4 has a differently-sized fixed ball 5 at its end. The balls 5 have small diameters, typically within a range of about 1/16–3/16 inch, and are fixedly attached or integrally extend out from cylindrical shafts 6. The shafts 6 taper from a larger diameter (about the same as the ball diameter) at a mid-region on the shaft to a smaller diameter (smaller than the ball diameter) at the connection point 8 of the shaft to the ball. Thus, there is no structure extending around the ball and no structure extending out to the side of the ball, so that, in use, only the ball is in the vicinity of the media being embossed and in the vicinity of the channel of the template. Therefore, there is a tendency for this tool to be rougher on certain kinds of paper because it isn't pressure-sensitive, that is, it doesn't adjust or self-adjust in response to pressure exerted on it.

Another tool that has a sphere on its end is the rolling ball burnisher by CHARTPAC™, illustrated in FIG. 1B. This tool is manufactured for letter transfer burnishing. The burnisher has a handle 11 and a single burnishing end 12. The burnishing end 12 has a tapered shaft 13 with a cup 14 holding a rolling ball 15. The shaft is slidable on its longitudinal axis relative to the handle, and is spring-loaded in the handle 11, so that the shaft is biased outward but may be forced further into the handle. The burnisher 10 includes, opposite the burnishing end 12, an adjustment mechanism for the biasing system to increase/decrease the outward bias on the shaft. Thus, the adjustment mechanism may be used, in effect, the amount of force applied on the media being burnished. In this burnisher 10, the ball 15 rolls inside the cup 14, but is not itself spring-biased relative to the rest of the end 12. There is no structure extending any significant distance out from the sides of the ball, but rather only the ball presenting itself to the media being burnished. The tool has a single ball of a small diameter, and has only enough structure to hold the ball, but does not have any structure extending out from the ball to guide or support the tool during use.

Still, there is a need for an improved hand-held embossing tool. There is a need for a tool that is usable for a wide variety of media, without tearing or marring the media. There is a need for a tool that may be used with or without a light-box, and that may be used successfully by individuals of varying talents and experience levels. This invention meets these needs.

SUMMARY OF THE INVENTION

The present invention is a hand-held, spring-loaded, rolling ball double-ended embossing tool. The double ends each have a differently-sized ball, which are used for different weight paper and templates with differently-sized apertures or impressions, herein called "channels." Preferably, each ball is resiliently biased into an outward position in its housing, which biasing provides a "suspension" for the ball, in effect, that maintains substantially constant pressure on the paper to ensure even embossing. The ball retainer holds the ball so that it is rollable. Also, the preferred ball retainer or other structure of the tool extends out to the side of the ball, preferably all the way around the ball, sufficiently to ride along on the media beside the channel to guide the ball, that is, help keep the rolling ball in the channel in a controllable, consistent, and non-marring, non-tearing manner. This ball guide feature allows the invented tool to be used by most people to emboss media without a light-box. Preferably, the ball retainer is anodized and the ball is stainless steel, which help prevent corrosion to prevent artifacts from showing up on the paper.

It is an object of the present invention to provide a versatile embossing tool that may be used for many media, such as different types and weights of paper, without extra equipment such as a light-box. It is a further objective to provide an easily-held, light-weight tool, allowing improved grip and reduced fatigue. Further, another objective is to provide roller ball diameters that are convenient for most scrap-booking templates.

DESCRIPTION OF THE PREFERRED EMBODIMENTS

Figures 1A, 1B:
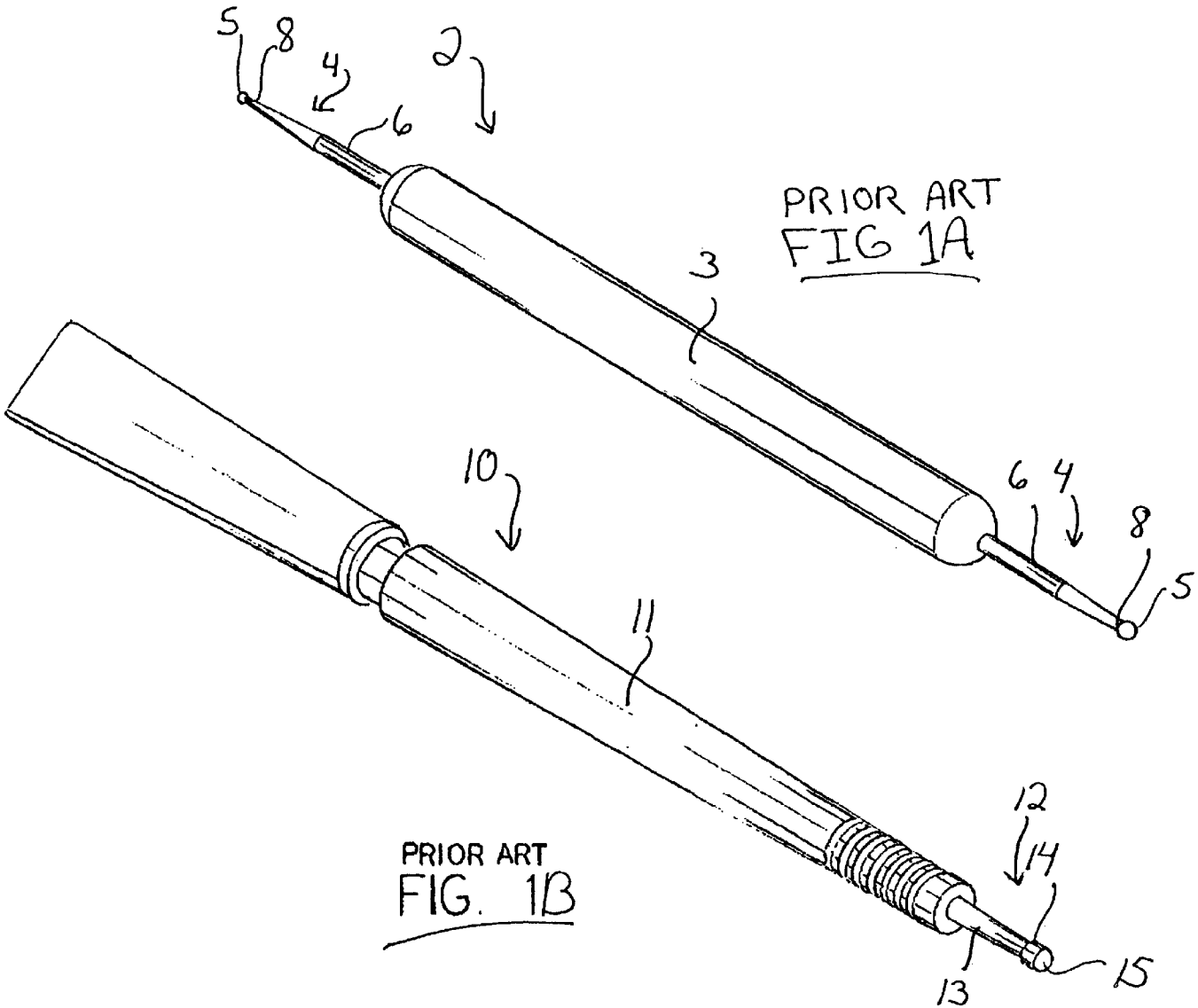
FIG 1A PRIOR ART
FIG. 1A is a perspective view of a prior art stylus tool.
FIG. 1B is a perspective view of a prior art burnishing tool.

Referring to the Figures, there are shown examples of the prior art, and a preferred, but not the only, embodiment of the invented embossing tool. FIG. 1A shows a conventional stylus that has been used in the past for hand-embossing of paper. FIG. 1B shows a newer burnishing tool with a single end wherein the burnishing assembly shaft is spring-loaded in the handle. FIGS. 2–5 illustrate the preferred construction and use of the invented embossing tool, which allow use without a light-box and which provide efficient and trouble-free embossing without marring or tearing of paper and without skipping or dragging on the paper.

Figure 2:
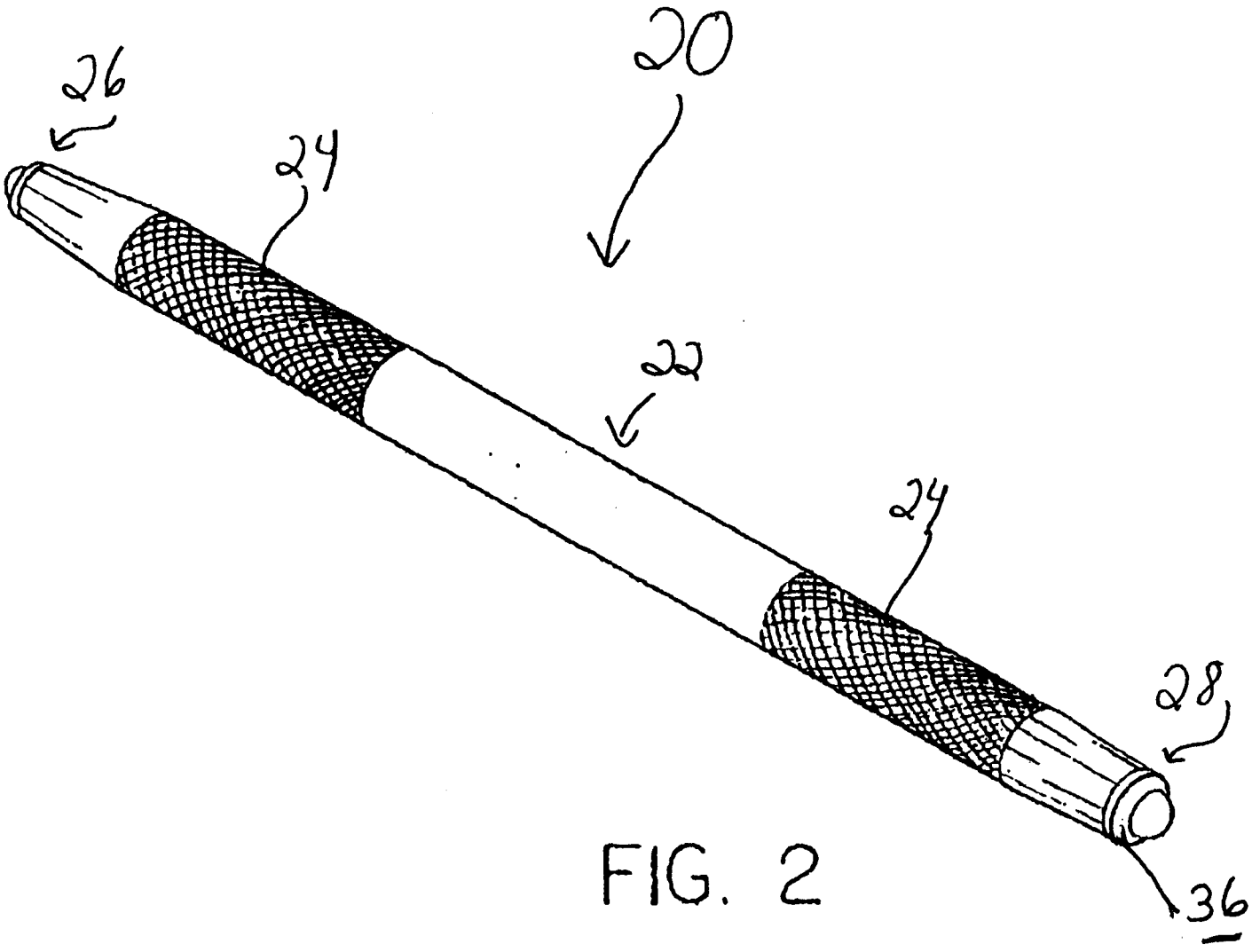
FIG. 2 is a perspective view of one embodiment of the invented embossing tool.
Figures 3A, 3B:
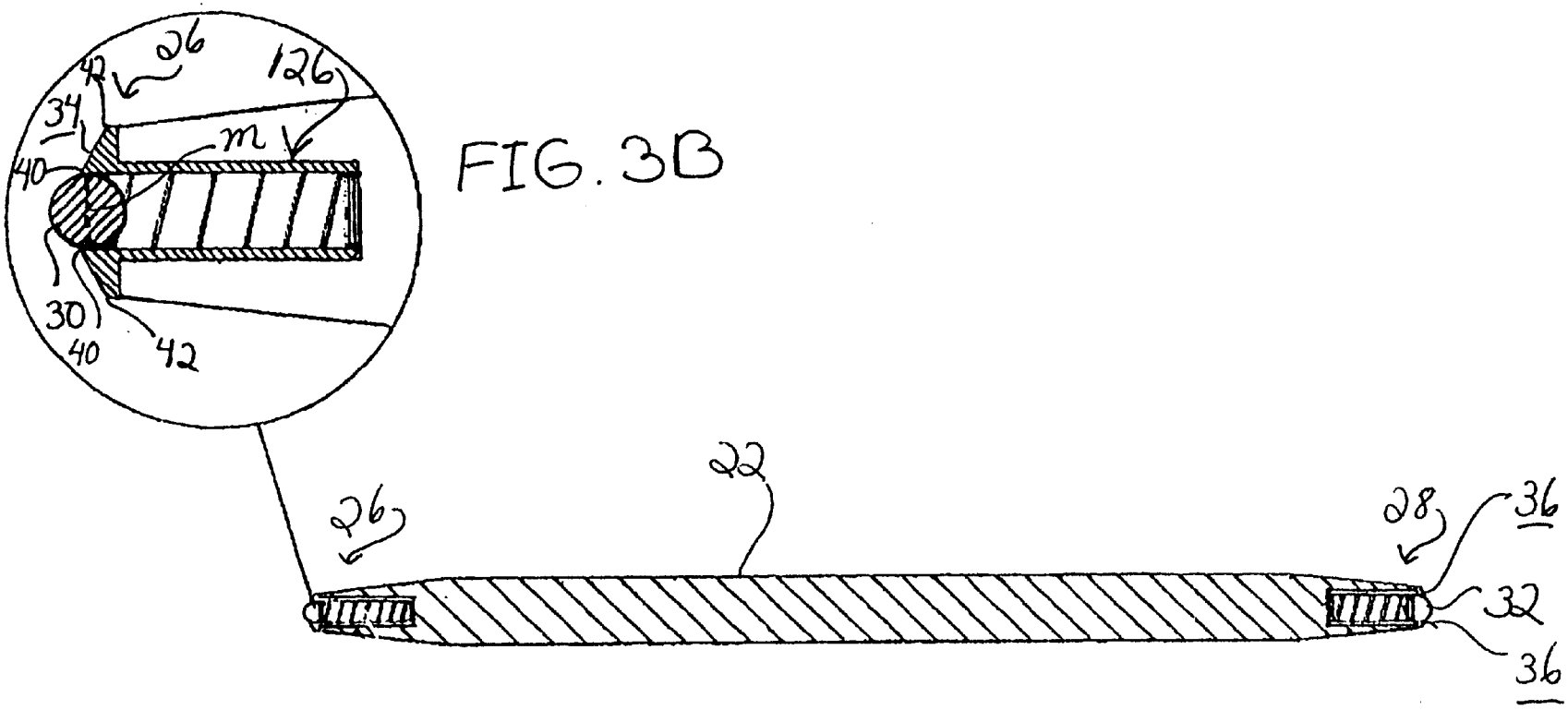
FIG. 3A is a side, cross-sectional view of the embodiment of FIG. 2.
FIG. 3B is a detail, side, cross-section detail of one tip of the invented tool of FIGS. 2 and 3A.
Figure 4:
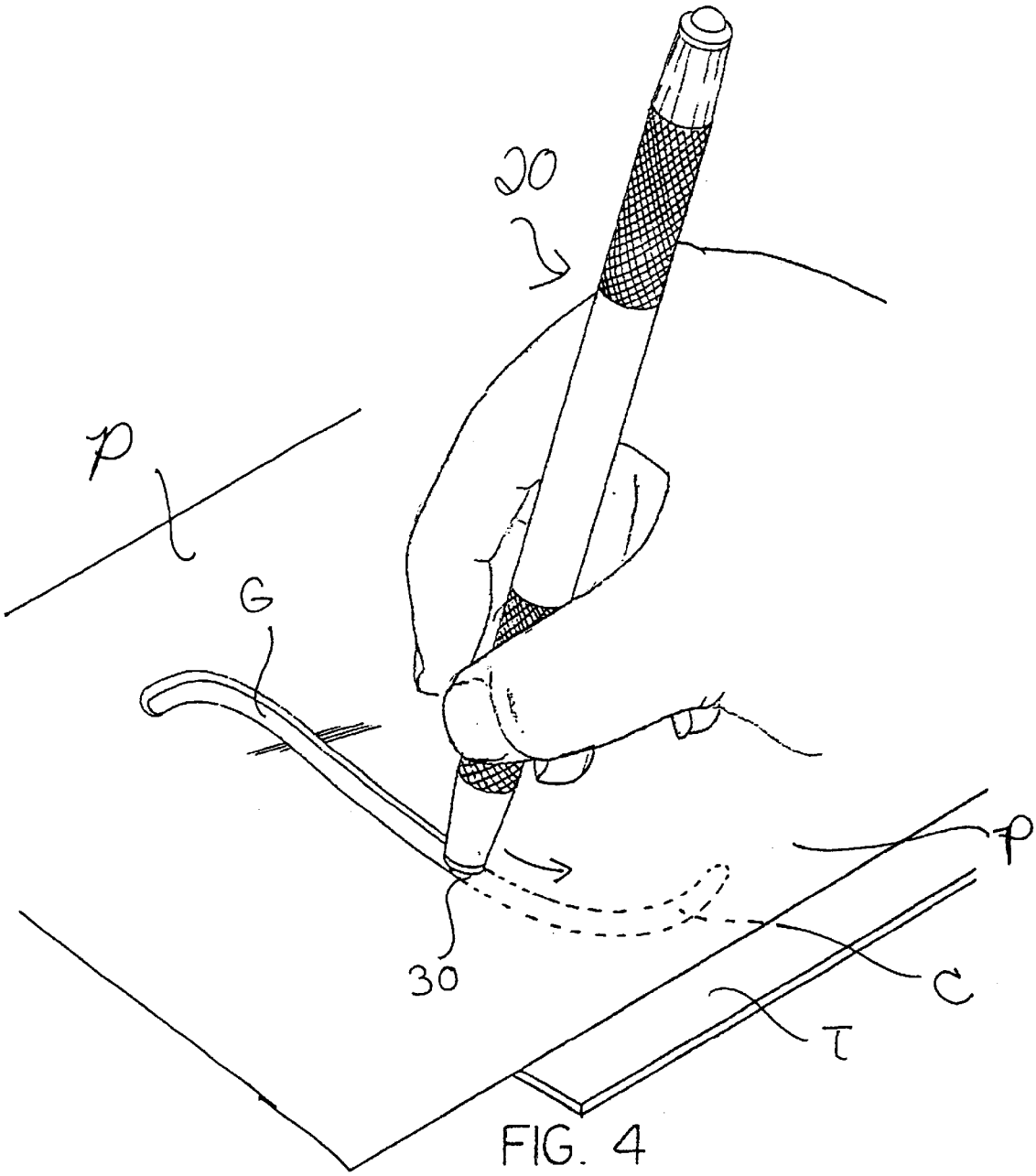
FIG. 4 is a perspective view of one method for using the embodiment of FIGS. 2–3, that is, blind embossing of a sheet of media by pressing a portion of the back surface of the media sheet into a channel of an underlying template.
Figure 5:
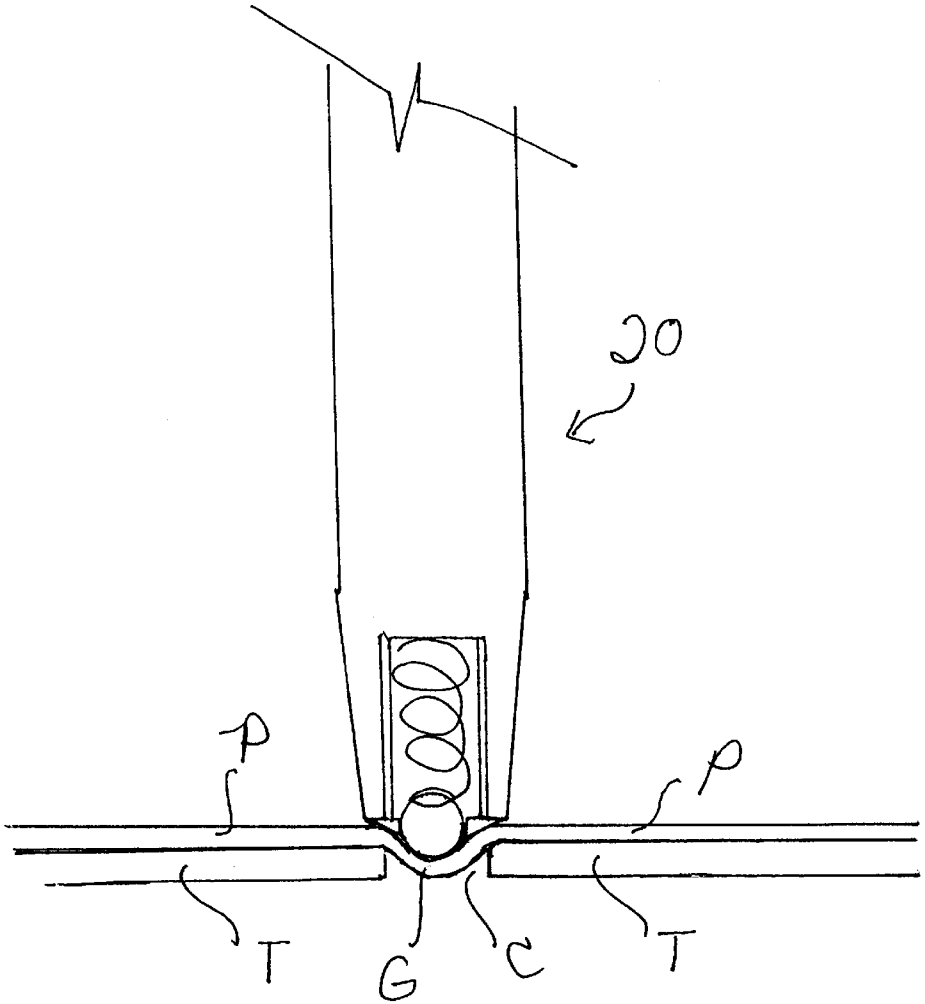
FIG. 5 is an end cross-sectional view of a tip of the invented tool running along a channel of a template during embossing, illustrating the guiding feature of the invented embossing tip.

In FIG. 2, one may see the outside of the invented tool 20, and in FIGS. 3A and 3B, one may see the internals of the tool 20. The centrally-disposed handle 22 includes knurling 24 near each end of the tool, for improving grip of the tool. At each end is a tip 26, 28 with a roller ball. Each tip 26, 28 includes a ball 30, 32 that is spring-mounted inside a retainer 126 (preferably a press-fit ball plunger as described below) in the end of the tool, so that slightly less than half of the surface of the ball is an exposed surface. A guide surface 34, 36 preferably surrounds each ball and extends out to the sides of the ball. The guide surface 34, 36 extends to very near the ball, with preferably enough clearance between the ball and the guide surface to allow the ball to rotate freely in the retainer. The guide surface 34, 36 extends generally radially outward from the ball from its inner edge 40, which is forward from the mid-line "M" of the ball (so that the ball is held in the retainer by the inner edge 40) to its outer edge 42 which is rearward from the inner edge 40 and which is preferably behind the mid-line M of the ball. "Forward" and "rearward" here are defined for convenience as towards the left edge of FIG. 3B and towards the right edge of FIG. 3B, respectively. Thus, the guide surface extends generally transversely to the longitudinal axis of the tool, preferably 360 degrees around the ball, and is slanted about 25–40 degrees from its edge 40 to its edge 42 (see enlargement, FIG. 6), and more preferably 30–35 degrees. The guide surface of the smaller tip is preferably slanted about 30 degrees, and the guide of the larger tip is preferably about 35 degrees. When the tip is pressed against the paper, the paper "sees" the ball pressing against and also the slanted guide surface 34, 36, which serves purposes described below.

Each ball and guide surface is sized appropriately for a group of templates. For example, many typically templates in the scrap-booking field have channels in them that are about 0.2–0.3 inches across from channel edge to channel edge. Thus, for the lower end of that channel width range, a preferred ball is about 0.15 inch diameter and a preferred guide surface extends for a total diameter of about 0.25 or slightly more. For the upper end of that channel width range, a preferred ball is about 0.18 inch diameter and the preferred guide surface extends for a total diameter of about 0.31 or slightly more. Thus, one may see that a preferred adaptation is to have the ball about 0.09–0.13 inches less in diameter that the guide surface outer diameter, for use with templates with channel widths about midway between the particular tip's ball diameter and guide surface diameter. Alternatively, one may describe preferred embodiments as having a guide surface with an outer diameter of about 1.5–1.8 times the diameter of its cooperating ball. This way, the ball extends into the channel area while the guide surfaces supports and guides the tool tip along, and the guide surface need not contact the paper at an exact radius on its surface because there is some leeway depending on the pressure applied by the user and the particular template and paper. Ball size and biasing tensions may be designed for a variety of specific templates, tastes, and purposes.

Thus, during use, the tip 26, 28 is pressed down on the paper "P" directly over the channel "C", and the pressure of the ball 30, 32 forces the paper to bend/stretch into the channel, creating grooves in the paper corresponding to the channel(s) shapes. These grooves appear as raised embossing when the paper is lifted from the template and the front surface of the paper is viewed.

An important feature of the invented tool 20 is that the guide surfaces 34, 36 form a flange that is preferably adapted to rest on the edges of the channel, actually on the paper over the surfaces of the template immediately adjacent the channel, when the ball is on the paper directly above the channel. When the user presses the ball into the channel the guide surfaces move down to press on the paper over one or both of the channel edges, and this serves to stabilize the tip 26, 28 in the channel. In other words, the guide surfaces rest outside the channel and serve to limit the downward vertical movement of the tip relative to the paper and template. This way, the tip 26, 28 will not entirely poke into the channel and tear the paper, but only the ball, and possibly an "inner ring" of the guide surface immediately adjacent to the ball, are allowed to enter the channel. This guides the ball into the channel, and guides the tip to find the channel, so that a light-box is normally not needed. Using the purposeful contact of the guide surfaces on the paper at the edges of the channel, the user can more easily "find the channel" and "stay in the channel" as he/she moves the tool along the length of the channel, without marring or gouging the paper and without leaving the channel. He/she can do this without actually seeing the channel, and so does not need a light-box. Because of the ball preferably being nearly as large in diameter as the width of the channel, and the gradually-slanting-away guide surfaces being available to contact the channel edges, the tip 26, 28 may be moved along the paper on top of the template until the ball "falls" into the channel of interest, and, from there, the tip is easily guided along the channel.

The preferred ball retainer system comprises a press-fit ball plunger system, such as the version shown in FIG. 3B. The plunger system of FIG. 3B includes a generally cylindrical housing 50, with a first preferably closed end 52 and a second open end 54. The rolling ball is retained in the open end by the inner circumference or "inner ring" of the housing wall that extends slightly inward trap the ball, while allowing it to roll freely inside the housing. A spring extends from the closed end 52 to the inner surface of the ball, and is adapted to push on the ball to bias it outwards. Thus, the system may be called a plunger system, because force on the ball from the outside tends to move it into the housing interior space. The spring is preferably non-adjustable, and the user quickly becomes accustomed to the biasing and to the technique of embossing. Preferably the ends of the tool each have a cylindrical bore in them to frictionally receive a plunger system.

The dimensions of the preferred tool 20 have been developed to be appropriate for many standard scrap-booking templates, but certainly other dimensions may apply for alternative templates and media. The preferred tool 20 has a smaller end (tip 26) and a larger end (tip 28). For tip 26, the dimensions are:

- tip diameter —0.25 inch;
- bore of 0.188 inch inner diameter (ID) and about 0.500 inch deep into the end of the tool;
- knurling about 1.25 inches long around the entire circumference of the tool starting about 0.685 from the end of the tool;
- ball diameter —0.156 inch;
- outer diameter of flange (outer circumference of guide surfaces, which preferably matches outer diameter) of tip —0.25 inch; and spring —1.25 kg +/–0.25 kg.

The opposite end, tip 28, is preferably the larger of the two ends, and has the following dimensions:

tip diameter —0.312 inch;

bore of 0.25 inch inner diameter (ID) and about 0.500 inch deep into the end of the tool;

knurling about 1.25 inches long around the entire circumference of the tool starting about 0.685 from the end of the tool;

ball diameter —0.188 inch;

outer diameter of flange (outer circumference of guide surfaces, which preferably matches outer diameter) of tip —0.312 inch; and spring —1.85 kg +/–0.25 kg.

Both of the above tips 26, 28 are used with a central handle area of about 0.4 inch diameter, and the entire tool is preferably about 6 inches long.

Plunger systems that are appropriate for use in the invented tool may be obtained, for example, from Carr Lane Manufacturing Co., of St. Louis, Mo. Such ball plungers, for example, may have: a body (housing) of 12L14 Steel, Black oxide finish, and a ball of 440C Stainless Steel, and a spring of music wire. Alternatively, for example, the body (housing) may be 300 series stainless steel; with a 440C stainless steel ball, and a 302 stainless steel spring. Less expensive housings may be anodized. The balls used in the tool are preferably non-porous, with extremely smooth spheres, as they should be adapted not to pick up any material.

Also, it may be noted that the preferable tool body is solid aluminum, and does not have any interior cavities except for the bores that receive the plunger systems. The body of the tool is therefore substantially solid and strong. Also, all the materials in the tool preferably are metal, but may alternatively include other solid materials such as wood or plastic. Preferably no liquids or liquid seals are included in the tool, except optionally a lubricant for the rolling balls.

Figure 6:
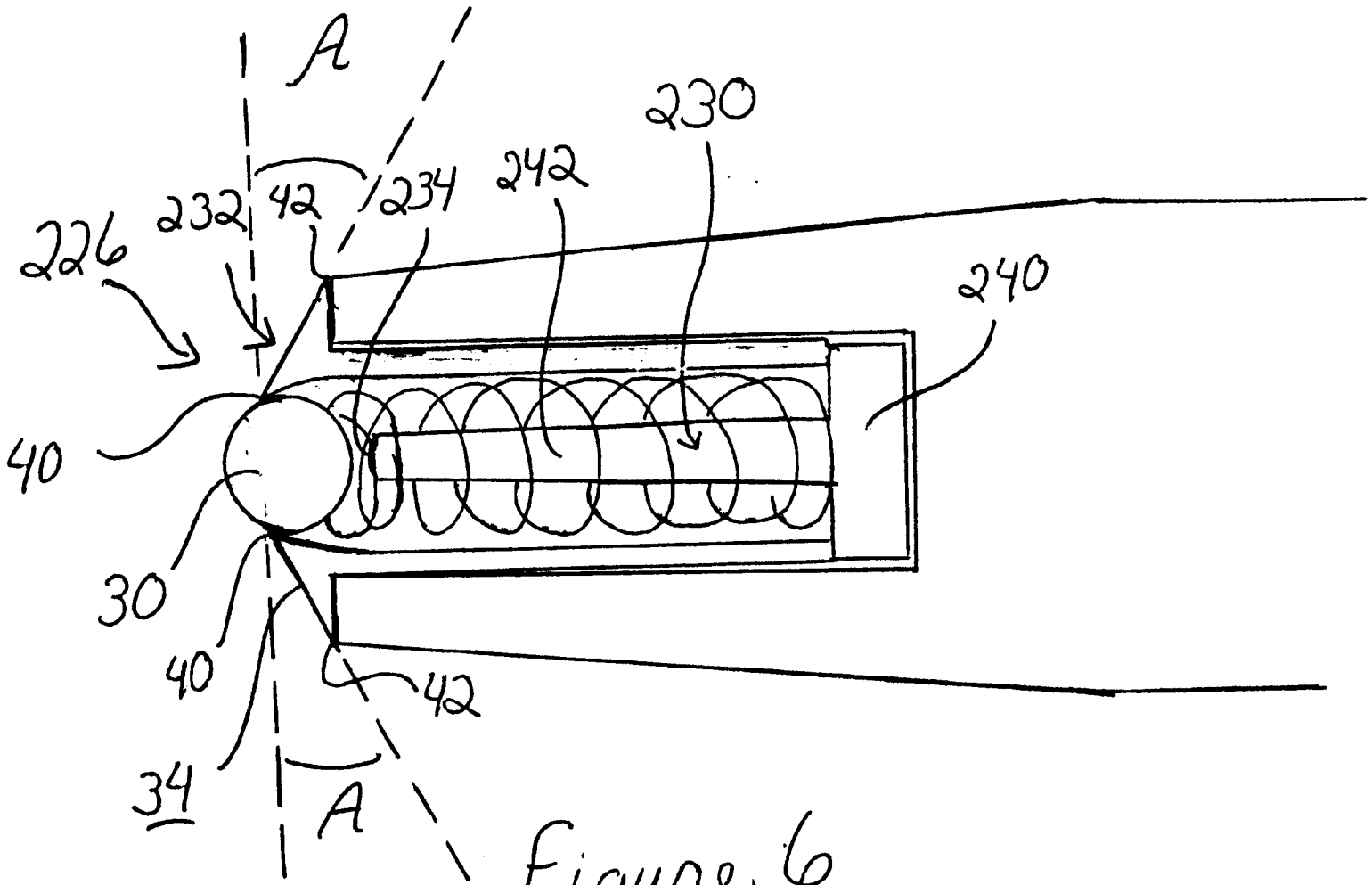
FIG. 6 is a side, cross-sectional view of an especially-preferred embodiment of a tip of the invented embossing tool.

An alternative, especially-preferred tip 226 is shown in FIG. 6. This tip 226 includes a ball stop 230 for limiting the distance the ball 30 can retract into the retainer 232. The preferred ball stop 230 extends into the retainer 232 to place its stop surface 234 behind the ball 30 a distance that prevents the ball from moving completely into the retainer 232. The retainer 232 of FIG. 6 has an open end into which the ball stop 230 is inserted and secured. The bore in the preferred tool for receiving especially-preferred tip 226 is deep enough to receive both retainer and ball stop, preferably about 0.65 inches. The ball stop 230 has an enlarged end flange 240 that abuts against and is preferably secured to the retainer, and a coaxial protrusion 242 having at its end the stop surface 234. The preferred protrusion 242 is an elongated member which is sized relative to the retainer and ball so that the stop surface extends to within a distance from the ball surface equal to about ¼–⅓ ball diameter. Thus, with the ball protruding out from the retainer less than ½ of its diameter, and with the ball only retractable less than about ¼–⅓ ball diameter before hitting the stop surface 234, the ball is always retained so that it protrudes out from the retainer for contact with the paper or other media. The ball always contacts the paper, no matter how hard the tool is pressed against the paper. This prevents the ball 30 from retracting so far that the retainer edge 40 tears or mars the paper.

Alternative structures may be used to accomplish the ball retaining and limiting and the tool guiding. For example, the ball retainer and ball stop system shown in the Figures are preferred, but other structures may be used for these functions. For example, the ball retaining structure may be much more shallow, with a shorter spring, and an integral stop may extend toward the ball from the retainer wall or floor. Also, one may notice that the preferred guide surface is part of the retainer, but other guide surfaces may be provided. For example, the handle around the retainer, or an insert around the retainer, may extend out to the sides of the ball to form a guide surface.

Although this invention has been described above with reference to particular means, materials and embodiments, it is to be understood that the invention is not limited to these disclosed particulars, but extends instead to all equivalents within the scope of the following claims.

We claim:

1. A hand-held embossing tool system comprising a template having a channel and having a template surface beside the channel, a sheet of media lying on said template, and an embossing tool for embossing the sheet of media, wherein the embossing tool comprises:

an elongated handle having a first end and a second end and a longitudinal axis;

a roller ball pressing on said sheet of media over said channel of the template;

a retainer attached to the first end of the handle and rollably receiving the roller ball so that the roller ball may roll in the retainer and so that an exposed surface of the ball is exposed and contacts the sheet of media;

a biasing member contacting the roller ball and biasing the roller ball in a direction outward from the elongated handle in parallel to the longitudinal axis; and a guide surface disposed on or near the first end around the roller ball that extends out from the roller ball generally transverse to the longitudinal axis near the exposed surface of the roller ball and that contacts the sheet of media over the template surface beside the channel.

2. The hand-held embossing tool system of claim 1, wherein the guide surface is generally circular and extends 360 degrees around the roller ball.

3. The hand-held embossing tool system of claim 1, wherein the biasing member is a spring.

4. The hand-held embossing tool system of claim 1, wherein the roller ball is a non-porous ball, and wherein the embossing tool does not contain any liquid.

5. The hand-held embossing tool system of claim 1, wherein the guide surface slants outward from the roller ball toward the second end of the handle.

6. The hand-held embossing tool system of claim 1, wherein the retainer comprises a generally cylindrical housing containing a spring parallel to the longitudinal axis and the housing has an outer end with a radially-outward-extending flange that is the guide surface.

7. The hand-held embossing tool system of claim 1 wherein the retainer further comprises a ball stop surface for limiting movement of the ball inward into the retainer.

8. The hand-held embossing tool system of claim 1, wherein the embossing tool further comprises:

a second roller ball;

a retainer attached to the second end of the handle and rollably receiving the second roller ball so that the second roller ball may roll in the retainer and so that an exposed surface of the second roller ball is exposed for contact with the sheet of media;

a biasing member contacting the second roller ball and biasing the second roller ball in a direction outward from the elongated handle in parallel to the longitudinal axis; and a guide surface disposed on or near the second end around the second roller ball that extends out from the second roller ball generally transverse to the longitudinal axis near the exposed surface of the second roller ball.

9. The hand-held embossing tool system of claim 8, wherein the guide surface around the second roller ball is generally circular and extends 360 degrees around said second roller ball.

10. The hand-held embossing tool system of claim 8, wherein the biasing member contacting the second roller ball is a spring.

11. The hand-held embossing tool system of claim 8, wherein the second roller ball is a non-porous ball.

12. The hand-held embossing tool system of claim 8, wherein the guide surface around the second roller ball slants outward from the second roller ball toward the first end of the handle.

13. The hand-held embossing tool system of claim 8, wherein the retainer attached to the second end of the handle comprises a generally cylindrical housing containing a spring parallel to the longitudinal axis and the housing has an outer end with a radially-outward-extending flange that is the guide surface around the second roller ball.

14. A method of embossing a media with a hand-held tool, the method comprising:

providing a template comprising a channel and template surfaces on each side of the channel;

covering the channel and the template surfaces on each side of the channel with a sheet of media;

pressing the media into the channel by pushing a tip of a hand-held tool on the media over and beside the channel, wherein the tip comprised a roller ball and a guide surface extending out from the ball, and wherein the roller ball is smaller in diameter than the channel is wide and the guide surface is larger in diameter than the channel is wide; and wherein pushing the tip on the media comprises the guide surfaces resting on the media beside the channel and the roller ball resting on the media directly over the channel.

15. The method of claim 14, wherein the roller ball is spring-biased outward from the tool.

16. The method of claim 14, wherein the guide surface is generally circular and extends around the roller ball 360 degrees.

* * * * *